United States Patent [19]

Reiniche

[11] 4,318,440

[45] Mar. 9, 1982

[54] PROCESS AND INSTALLATION FOR THE MANUFACTURE OF A METAL WIRE FROM A JET OF MOLTEN METAL

[75] Inventor: Andre Reiniche, Clermont-Ferrand, France

[73] Assignee: Compagnie Generale des Etablissements Michelin, Clermont-Ferrand, France

[21] Appl. No.: 173,866

[22] Filed: Jul. 30, 1980

[30] Foreign Application Priority Data

Aug. 1, 1979 [FR] France ..... 79 19927

[51] Int. Cl.[3] ..... B22D 11/124

[52] U.S. Cl. ..... 164/462; 164/423; 226/97

[58] Field of Search ..... 164/423, 440, 443, 462, 164/485, 490; 226/97; 264/176 F

[56] References Cited

U.S. PATENT DOCUMENTS

| | | | |
|---|---|---|---|
| 2,879,566 | 3/1959 | Pond | 164/462 |
| 3,218,681 | 11/1965 | Ditto | 164/462 |
| 3,415,922 | 12/1968 | Carter et al. | 264/176 F |
| 4,020,891 | 5/1977 | Adler | 164/462 |
| 4,149,584 | 4/1979 | Pflieger et al. | 164/423 X |
| 4,153,099 | 5/1979 | Pflieger et al. | 164/462 |

*Primary Examiner*—Robert D. Baldwin

*Attorney, Agent, or Firm*—Brumbaugh, Graves, Donohue & Raymond

[57] ABSTRACT

In a process and installation for the manufacture of a metal wire from a jet of molten metal, the jet of metal which is in the course of solidification is supported by cooling fluid displaced by two cylinders rotating in opposite directions with a tangential velocity such that the wire is supported in stable equilibrium in the plane of vertical symmetry of the two cylinders above the level defined by the plane perpendicular to the plane of symmetry and passing through the axes of rotation of the two cylinders, the space between the two cylinders being between about 0.15% and 3% of their common radius and their peripheral speed being between about 4 and 120 m/sec.

5 Claims, 6 Drawing Figures

Figure 1A:
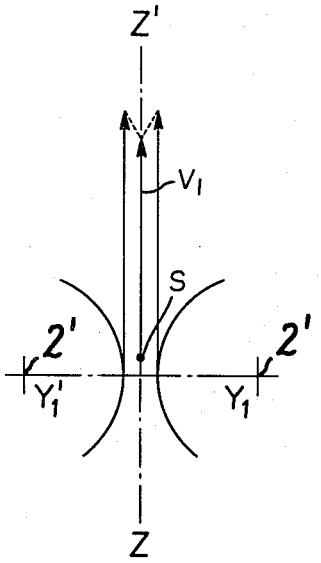

PROCESS AND INSTALLATION FOR THE MANUFACTURE OF A METAL WIRE FROM A JET OF MOLTEN METAL

The present invention concerns improvements in installations and processes for manufacturing a wire from a jet of molten metal or metallic alloy.

Such installations essentially comprise a crucible containing the molten metal or metallic alloy, a die arranged in the wall of the crucible, an enclosure containing a pressurizing fluid which pressurizes the molten metal or metallic alloy in the crucible, a cooling enclosure following the die and containing a cooling fluid intended to cool the jet of molten metal or metallic alloy projected into the cooling enclosure through the die under the effect of the pressurizing fluid.

It is known in such installations to deposit the jet on a stream of gas which forms an acute angle with and supports the jet (liquid) while cooling it until the jet becomes a wire (solid). This makes it possible to increase the diameter of the wire when the weight of the wire would cause a break in the continuity of the jet which has given rise to it. Such installations require the circulating of large flows of gas and therefore fans of high power. Furthermore, the stability of the trajectory of the wire resting on the stream of gas is precarious and it may happen that this trajectory moves substantially away from the vertical plane in which it is desired that it be contained.

The object of the invention is to provide a process and means for the carrying out thereof in order to effect simultaneously the cooling, supporting and stabilizing of the jet and wire on a practically linear trajectory which is fixed with respect to the manufacturing installation, this trajectory being referred to as the axis of stability of the wire.

Therefore, in accordance with the invention, the process is characterized by the fact that the axis of the die forms an angle of between 45° and 90° with the descendant vertical and is contained, as is the axis of stability of the wire, within a vertical plane, and by the fact that in a plane cross section perpendicular to the axis of stability of the wire the velocity of the cooling fluid is distributed, on the one hand, symmetrically with respect to the vertical plane so as to reach a minimum in the vertical plane and have a component parallel to the minimum velocity, the value of which increases on both sides of the vertical plane and, on the other hand, in such a manner that the minimum velocity at the level of the axis of stability of the wire has a value sufficient to support the wire and impart to it a practically linear trajectory along its axis of stability, and upstream of the axis of stability a higher value and downstream of the axis of stability a lower value than the value at the level of the axis of stability of the wire.

Thus, the flow of the cooling fluid, in gaseous state or a mixture of gas and vapor and/or mist, has, on the one hand, a transverse distribution of the velocities of flow, in every plane perpendicular to the wire, which is symmetrical with respect to the vertical plane containing the axis of the die and the axis of stability of the wire, in which vertical plane the velocities are minimum and, on the other hand, in the vertical plane a vertical distribution such that the velocity at the level of the wire imparts to the wire an aerodynamic thrust which neutralizes the component normal to the wire of the weight of the wire while being higher upstream of the wire and lower downstream of the wire.

Due to the transverse distribution of the velocities in accordance with the invention in any plane perpendicular to the wire, the wire when it moves transversely away from the vertical plane in which it should be contained is returned into the vertical plane as a result of the difference in the velocities of flow of cooling fluid on the faces of the wire which are furthest from and closest to the vertical plane.

As to the vertical distribution of the velocities in any plane perpendicular to the wire, it makes it possible to exert a higher aerodynamic thrust than the component normal to the wire of the weight of the wire when the wire follows a trajectory located below the axis of stability of the wire. Conversely, if the trajectory of the wire passes above the axis of stability of the wire to a level where the velocity is lower, the aerodynamic thrust is less than the component normal to the wire of the weight of the wire and the wire returns toward the axis of stability of the wire.

Due to the double distribution of the velocities in accordance with the invention in the plane perpendicular to the wire, the wire is therefore returned both transversely and vertically to the axis of stability of the wire. On the latter, the wire is borne by the thrust of the flow, equal to $\frac{1}{2}C_z\rho V^2_m$ ($C_z$ is the coefficient of perpendicular thrust per unit of length, which is essentially a function of the diameter of the wire; $\rho$ is the specific weight of the cooling fluid and $V_m$ is the average local velocity at the level of the wire).

The process of the invention is preferably combined with cooling by a flow of the cooling fluid having a velocity component parallel to the axis of stability of the wire. The velocity and the direction of the flow are advantageously the same as those of the wire on its axis of stability. The aerodynamic drag parallel to the axis of stability of the wire is thus practically cancelled out. One thus avoids geometrical defects, such as undulations or zig-zagging of the wire.

On the other hand, the aerodynamic drag of the wire can be neutralized by inclining the axis of stability of the wire (the axis of the die) in such a manner that the component of the weight of the wire parallel to the axis of stability of the wire is, in absolute value, at most equal to the aerodynamic drag of the wire in the cooling fluid and of a direction opposite thereto. The angle between the axis of stability of the wire and the descendent vertical is, therefore, preferably between about 40° and 90°.

The drawing illustrates the operation of the invention and gives examples of relatively simple means for the carrying out of the process of the invention.

Figure 1B:
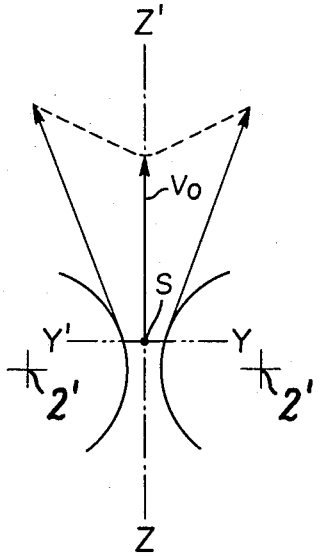
Figure 1C:
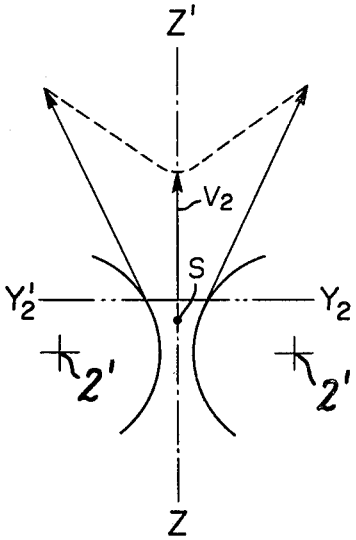
Figure 2:
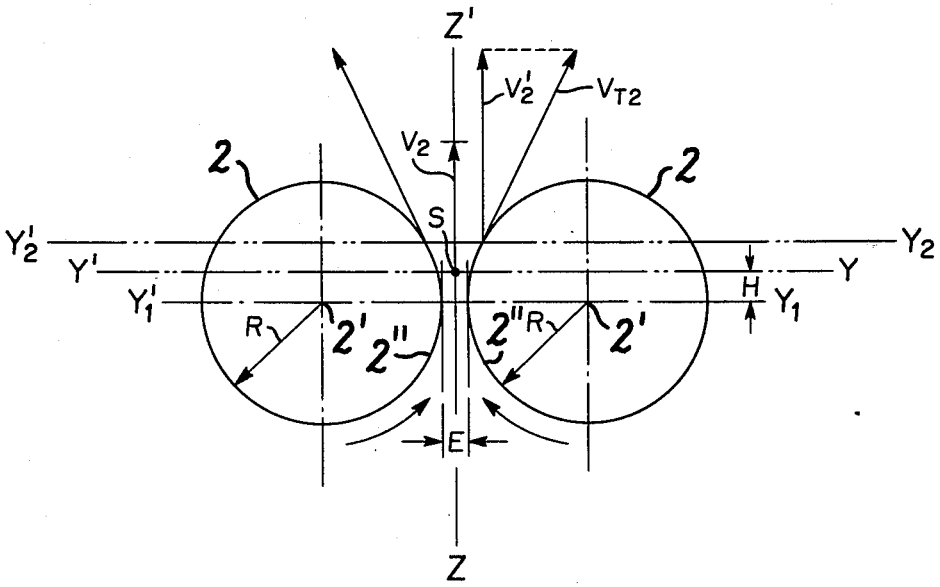
Figure 3:
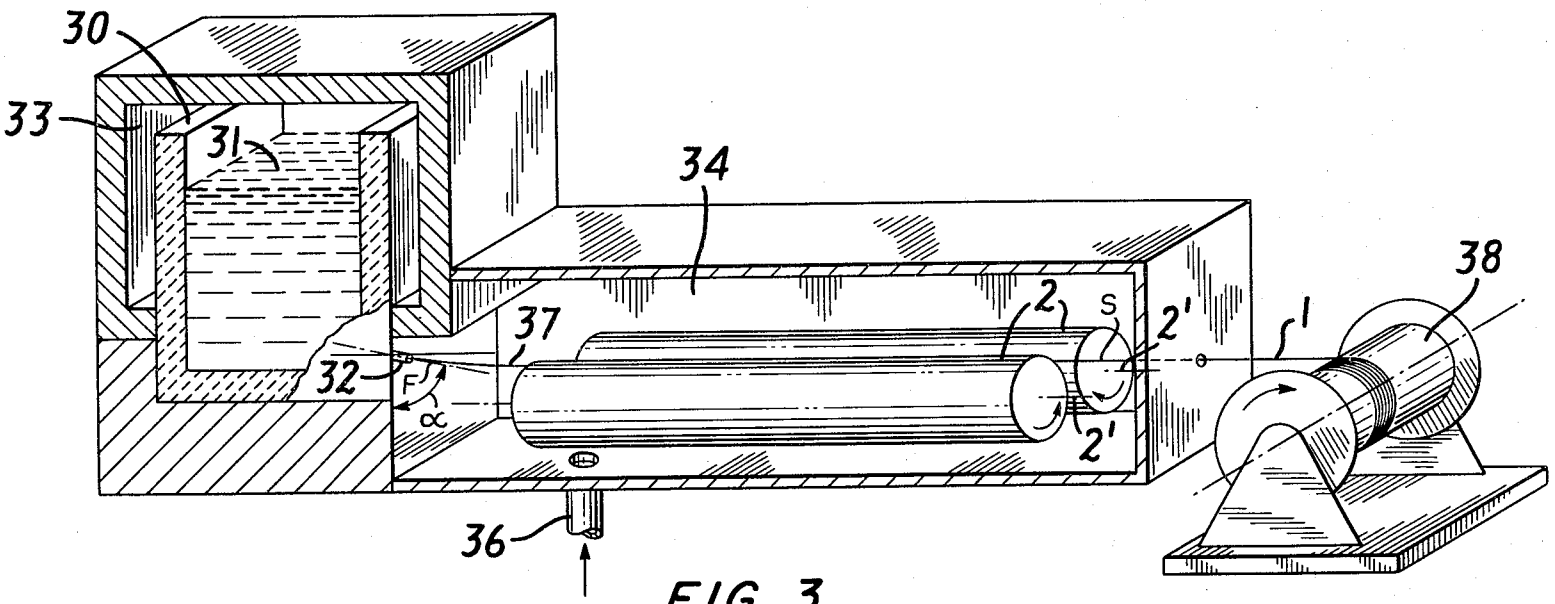
Figure 4:
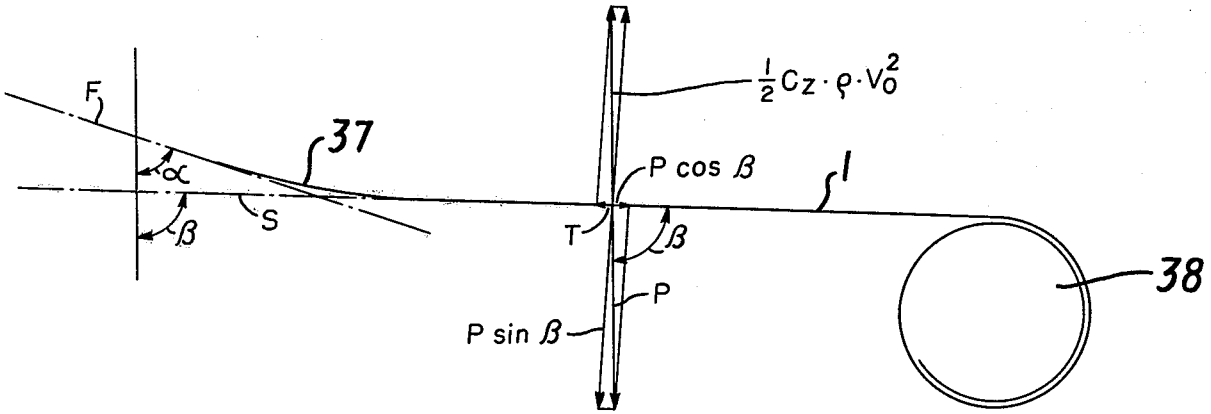

In the drawing:

FIGS. 1A, 1B and 1C show an example of the distribution of the velocities at different stability levels of the wire, FIG. 2 shows, in schematic cross section, perpendicular to the axis of the die, a device for producing a field of velocities in accordance with the invention by means of two cylinders, FIG. 3 shows, in partial section along the vertical plane containing the die, the essential elements of an installation such as that claimed, in which the field of velocities is produced by the cylinders of FIG. 2, and FIG. 4 is a diagram of the forces acting on the unit of length of the wire on the axis of stability of the wire in the installation of FIG. 3.

Referring to FIGS. 1A, 1B and 1C, ZZ' is the trace of the vertical plane containing the axis F of the die and the axis of stability S of the wire. The horizontal level corresponding to the stable position of the wire is indicated by the transverse line YY' (FIG. 1B) which intersects the trace ZZ' on the axis of stability S of the wire, forming a right angle.

The distribution of the velocities of the cooling fluid at the level $Y_1Y'_1$ (FIG. 1A) upstream of the level of stability YY' of the wire and at the level $Y_2Y'_2$ (FIG. 1C)downstream of said level, as well as at the level of stability YY' itself (FIG. 1B), is symbolized by arrows extending from one of the three parallel lines $Y_1Y'_1$, YY' and $Y_2Y'_2$. The arrows indicate the direction of the velocity and their length indicates the value of the velocity with respect to the level considered as one moves transversely away along the transverse axes $Y_1Y'_1$, YY' and $Y_2Y'_2$ from the vertical plane of trace ZZ' containing the axis of stability S of the wire and the axis F of the die. In accordance with the invention, the velocities are distributed symmetrically with respect to the plane of trace ZZ' and with respect to the minimum velocity located in this same plane perpendicular to the axis of stability S of the wire. These minimum velocities are $V_1$ upstream, $V_2$ downstream and $V_o$ at the level of stability YY' of the wire. In accordance with the invention, in the vertical plane of trace ZZ' the minimum velocity $V_1$ upstream is greater than the minimum velocity $V_o$ at the level of stability. $V_2$, the minimum velocity downstream of the level of stability YY', is in its turn smaller than $V_o$, the minimum velocity at the level of stability YY'. If P is the linear weight of the wire and $\beta$ the angle of the axis of stability S of the wire with the descendant vertical, using the same notations as above, one has, at the level of stability YY' of the wire: $P \times \sin \beta = \frac{1}{2} C_z \rho V^2_{om}$, $V_{om}$ being the average velocity acting (effective) on the wire when the latter is at its axis of stability S ($C_z$ and $\rho$ are as defined above).

A flow of the cooling fluid having a degressive symmetrical distribution in accordance with the invention is obtained (FIG. 2) by means of two cylinders 2 of the same radius R having parallel axes 2' and turning in opposite directions to each other so that the portions of the surfaces 2'' of the cylinders 2 close to the axis of stability S of the wire have ascending movements. This distribution is symmetrical with respect to the plane of trace ZZ' containing the axis of stability S of the wire in particular at the level of stability YY', the vertical plane of trace ZZ' being at the same time a plane of symmetry for the two cylinders 2 and the cylinders 2 being spaced from each other by a distance E which is between about 0.15% and 3% of the radius R of the cylinders 2. Due to its viscosity, the cooling fluid is carried along by the walls of the two rotating cylinders 2 so that, at the downstream level $Y_2Y'_2$, for instance, the velocity of the cooling fluid on the wall of the cylinders is $V_{T2}$. This velocity $V_{T2}$ has a component $V'_2$ parallel to the vertical trace plane ZZ' which is greater than the minimum velocity $V_2$ on the trace ZZ' due to the distance of this trace from the surfaces 2'' of the cylinders 2. At the level of stability YY' of wire, one has a distribution of these velocities (not shown) similar to that at the downstream level $Y_2Y'_2$. As a whole, the velocities and in particular the velocity of support $V_o$ of the wire in the plane of trace ZZ' are greater at this level of stability YY' than at the downstream level $Y_2Y'_2$, because the cylinders are closer to each other. At the level $Y_1Y'_1$ upstream of the wire, the velocity $V_1$ in the vertical trace plane ZZ' is higher than $V_o$, because the level $Y_1Y'_1$ passes through the axes 2' of the cylinders 2 and the distance between the two cylinders 2 reaches its minimum E at this level. The peripheral speed of the cylinders 2 is between about 4 and 120 m/sec.

FIG. 3 shows, schematically and in partial view, a crucible 30 containing molten metal 31, a die 32 arranged in the wall of the crucible 30, a pressurization enclosure 33 surrounding the crucible 30 and a cooling enclosure 34 following the die 32. Within the cooling enclosure 34 there are installed the rotating cylinders 2 in accordance with the invention, the axes of which are designated 2'. The axis F of the die 32 is inclined by an angle $\alpha$ equal to 85° with respect to the descendant vertical. The cylinders 2 are driven by a common motor (not shown) and rotate in opposite directions by means of a suitable transmission system (not shown). They can be provided with a circulation of cooling fluid in order to lower the temperature of the cooling fluid which penetrates into the cooling enclosure 34 via a connection 36 in the base thereof. The jet 37 emerging from the die 32 follows a trajectory which is slightly concave towards the top and then the jet 37 and wire 1 follow the substantially linear axis of stability S and the wire 1 arrives on a reel 38 which winds it up. The axis S is substantially parallel to the axes 2' of the cylinders 2.

The axis of stability S of the wire 1 is slightly inclined downward in order to neutralize the aerodynamic drag T of the wire (FIG. 4). However, the process in accordance with the invention also contemplates neutralizing the drag T, either partially or completely, by means of a flow (not shown) parallel to the axis of stability S of the wire 1 and of the same velocity (in direction and in absolute value) as that of the wire. In the case of neutralization by the inclination of the axis of stability S at an angle $\beta$ less than 90°, the inclination of the axis F of the die 32 is at an angle $\alpha$ smaller than the angle $\beta$. For example, for $\alpha = 85°$ one has $\beta = 87°$. The weight P of the wire forms an angle $\beta$ with the axis of stability S of the wire and the component $P \cos \beta$ of the linear weight P of the wire along the axis of stability S is equal to the drag T, but of opposite direction. The support force on the wire from the flow of cooling fluid in accordance with the invention is equal to $\frac{1}{2} C_z \rho V^2_o$.

As shown by the following examples, the level of stability YY' of the wire is located at a distance H from the level $Y_1Y'_1$ passing through the axis 2' of the cylinders 2. This distance H depends essentially on the specific weight and the diameter of the wire, the specific weight and the viscosity of the cooling fluid, and the radius R, the spacing E and the speed of rotation N of the cylinders.

EXAMPLE 1

Steel wire of 0.23 mm diameter

R = 0.08 m

Cooling fluid: 64 mol % atomized propane in 36 mol % of hydrogen

| E (mm) | N (rpm) | H (mm) |
|---|---|---|
| 0.5 | 500 | 2 |
| 0.5 | 800 | 7 |
| 1.0 | 600 | 5 |
| 1.0 | 700 | 6 |

EXAMPLE 2

Steel wire of 1.0 mm diameter
R=0.08 m
Cooling fluid: 64 mol % atomized propane in 36 mol % of hydrogen

| E (mm) | N (rpm) | H (mm) |
|---|---|---|
| 0.5 | 2,400 | 8 |
| 0.5 | 3,200 | 11 |
| 1.5 | 2,400 | 5 |
| 1.5 | 3,200 | 10 |

EXAMPLE 3

Steel wire of 2.5 mm diameter
R=0.10 m
Cooling fluid: 50 mol % atomized propane in 50 mol % of hydrogen

| E (mm) | N (rpm) | H (mm) |
|---|---|---|
| 1.0 | 3,600 | 20 |
| 1.0 | 5,900 | 24 |
| 2.0 | 5,200 | 16 |
| 2.0 | 6,700 | 20 |

EXAMPLE 4

Steel wire of 5.0 mm diameter
R=0.15 m
Cooling fluid: 60 mol % atomized propane in 40 mol % of hydrogen

| E (mm) | N (rpm) | H (mm) |
|---|---|---|
| 1.0 | 3,700 | 28 |
| 1.0 | 6,000 | 31 |
| 2.0 | 5,300 | 25 |
| 2.0 | 6,800 | 28 |

EXAMPLE 5

Conditions identical to those of Example 2. The velocity of the wire being 10 m/sec, the axes of rotation of the cylinders form an angle of 87½° with the descendant vertical. A substantial decrease in the undulations and zig-zags of the wire is noted.

Several pairs of cylinders can be arranged one behind the other as required.

The process of the invention permits considerable savings in space and energy. In the case of Example 3, the inner volume of the cooling enclosure is about 1 $m^3$ while the ordinary process requires a volume of 140 $m^3$. The power necessary for rotating the cylinders and furthermore assuring a ventilation of 10 m/sec parallel to the wire of the same velocity is only 28 kW instead of 300 kW for ventilation in accordance with the customary process.

The process of the invention can be applied, as shown by the examples, to wires whose diameter may be within a very wide range. Finally, the process of the invention is practically independent of the speed of projection of the jet of liquid metal, that is to say of the speed at which the wire passes between the two rotating cylinders.

Experience shows that the object of the invention is achieved when there is produced at the level YY' of the axis of stability S of the wire a flow of cooling fluid having an average transverse velocity gradient (along the axis YY') namely $\Delta V_o/\Delta y$ expressed in per second ($s^{-1}$) of between $$\sqrt{\frac{g}{d}\,\frac{\rho_m}{\rho}} \text{ and } 4\sqrt{\frac{g}{d}\,\frac{\rho_m}{\rho}}$$

in which:

$\rho_m$ is the specific weight of the wire in kg/m3
$\rho$ is the specific weight of the cooling fluid in $kg/m^3$
d is the diameter of the wire in meters
g is the acceleration of gravity in $m/s^2$

What is claimed is:

1. A process for manufacturing a metal or metallic alloy wire by projecting a jet of molten metal or metallic alloy through a die into a cooling enclosure containing a cooling fluid in which the jet solidifies into a wire along an axis of stability, the cooling fluid being imparted, at least until the solidification of the jet, a movement which is directed perpendicularly towards the jet, characterized by the fact that the axis of the die forms an angle of between 45° and 90° with the descendant vertical and is contained within the same vertical plane as the axis of stability of the wire, and by the fact that in a plane cross section perpendicular to the axis of stability of the wire the velocity of the cooling fluid is distributed symmetrically with respect to the vertical plane so as to reach a minimum in the vertical plane and to have a component parallel to the minimum velocity which increases on both sides of the vertical plane, said cooling fluid velocity also being distributed in such a manner that said minimum velocity at the level of the axis of stability of the wire has a value sufficient to support the wire and impart to it a practically linear trajectory along its axis of stability, said minimum velocity upstream of the axis of stability having a higher value and downstream of the axis of stability a lower value than said wire-supporting value at the level of the axis of stability of the wire.

2. The process according to claim 1, characterized by the fact that there is furthermore used a flow of the cooling fluid having a velocity component parallel to the axis of stability of the wire and having the same velocity and direction as those of the wire on its axis of stability.

3. The process according to claim 1, characterized by the fact that the axis of stability of the wire forms with the descendant vertical an angle of between about 40° and 90° so that the component of the weight of the wire tangent to the axis of stability of the wire is, in absolute value, at most equal to, but of opposite direction than, the aerodynamic drag of the wire in the cooling fluid.

4. The process according to claim 1, 2 or 3, characterized by the fact that at the level of the axis of stability of the wire the flow of the cooling fluid has an average transverse velocity gradient $\Delta V_o/\Delta y$ of between $$\sqrt{\frac{g}{d}\,\frac{\rho_m}{\rho}} \text{ and } 4\sqrt{\frac{g}{d}\,\frac{\rho_m}{\rho}}$$

in which $\rho_m$ is the specific weight of the wire of $kg/m^3$
$\rho$ is the specific weight of the cooling fluid in $kg/m^3$
d is the diameter of the wire in meters
g is the acceleration of gravity in $m/s^2$.

5. An installation for producing a metal or metallic alloy wire comprising a crucible, a die arranged in the wall of the crucible with the axis of the die forming an angle of between 45° and 90° with the descendant vertical and being contained within the same vertical plane as the axis of stability of the wire, a pressurization enclosure surrounding the crucible and a cooling enclosure following the die, characterized by the fact that in the cooling enclosure there is arranged at least one pair of cylinders of the same radius, the axes of the cylinders being parallel to each other, parallel to the vertical plane passing through the axis of the die and through the axis of stability of the wire and arranged symmetrically with respect to the vertical plane, the two cylinders being without contact with each other and adapted to turn in opposite directions with respect to each other from the bottom to the top with respect to the descendant vertical at a tangential velocity such that the wire is supported by the cooling fluid in stable equilibrium in the plane of vertical symmetry of the cylinders above the level defined by a plane perpendicular to the plane of symmetry and passing through the axes of rotation of the two cylinders, the space between the two cylinders being between about 0.15% and 3% of their common radius and their peripheral speed being between about 4 and 120 m/sec.

* * * * *